US006776233B2

(12) United States Patent
Meehan

(10) Patent No.: US 6,776,233 B2
(45) Date of Patent: Aug. 17, 2004

(54) METHOD AND SYSTEM FOR DRILLING A WELLBORE HAVING CABLE BASED TELEMETRY

(75) Inventor: Richard John Meehan, Sugar Land, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/192,438

(22) Filed: Jul. 10, 2002

(65) Prior Publication Data

US 2003/0029641 A1 Feb. 13, 2003

(30) Foreign Application Priority Data

Jul. 25, 2001 (GB) ..... 0118071

(51) Int. Cl.[7] ..... E21B 45/00

(52) U.S. Cl. ..... 166/250.01; 166/254.2; 166/65.1

(58) Field of Search ..... 166/250.01, 65.1, 166/254.2, 378, 380, 242.1, 242.3, 242.5, 242.6; 175/215, 40, 48, 50

(56) References Cited

U.S. PATENT DOCUMENTS

| | | | | |
|---|---|---|---|---|
| 3,906,434 A | * | 9/1975 | Lamel et al. | 367/82 |
| 4,001,774 A | | 1/1977 | Dawson et al. | |
| 4,057,781 A | | 11/1977 | Scherbatskoy | |
| 4,090,573 A | * | 5/1978 | Rankin | 175/45 |
| 4,098,342 A | | 7/1978 | Robinson et al. | |
| 4,143,721 A | | 3/1979 | Zuvela et al. | |
| 4,153,120 A | | 5/1979 | Zuvela et al. | |
| 4,181,184 A | | 1/1980 | Scherbatskoy | |
| 4,325,438 A | | 4/1982 | Zuvela | |
| 4,399,877 A | | 8/1983 | Jackson et al. | |
| 4,416,494 A | | 11/1983 | Watkins et al. | |
| 4,676,563 A | * | 6/1987 | Curlett et al. | 439/194 |
| 4,749,823 A | * | 6/1988 | Ziemek et al. | 174/103 |
| 4,757,859 A | | 7/1988 | Schnatzmeyer | |
| 4,792,802 A | | 12/1988 | Meadows | |
| 4,802,143 A | * | 1/1989 | Smith | 367/82 |
| 5,096,001 A | | 3/1992 | Buytaert et al. | |
| 5,105,878 A | | 4/1992 | Forest et al. | |
| 5,211,225 A | | 5/1993 | Grosch | |
| 5,294,923 A | | 3/1994 | Juergens et al. | |
| 5,722,488 A | | 3/1998 | Normann et al. | |
| 6,105,690 A | * | 8/2000 | Biglin et al. | 175/48 |
| 6,453,239 B1 | * | 9/2002 | Shirasaka et al. | 701/220 |
| 6,622,803 B2 | * | 9/2003 | Harvey et al. | 175/325.3 |

FOREIGN PATENT DOCUMENTS

| | | |
|---|---|---|
| CA | 2 250 323 | 4/1999 |
| GB | 1 418 209 | 6/1973 |
| GB | 1 433 265 | 10/1973 |
| GB | 2273 358 | 6/1994 |
| WO | 99/10674 | 3/1999 |

* cited by examiner

*Primary Examiner*—Frank S. Tsay
(74) *Attorney, Agent, or Firm*—William L. Wang; William B. Batzer; John J. Ryberg

(57) ABSTRACT

A method and system for cable-based communication between the drilling rig and the bottom hole assembly is disclosed. A cable is provided along the outside of an upper portion of the drillstring. The cable is connected to a cross-over sub assembly below which is attached a second cable that extends down towards the bottom hole assembly. During drilling the cable rotates with the drillstring, and the unused cable is stored in a reel mounted on the top drive unit. New pipe stands are connected and the cable is clamped to the outside of the drillstring. The method and system are particularly well suited for use in deep-water drilling environments.

27 Claims, 10 Drawing Sheets

METHOD AND SYSTEM FOR DRILLING A WELLBORE HAVING CABLE BASED TELEMETRY

FIELD OF THE INVENTION

The present invention relates to the field of wellbore drilling operations where telemetry is used. In particular, the invention relates to a method and system for wellbore drilling where cable based telemetry is used for communication between the surface and downhole devices.

BACKGROUND OF THE INVENTION

Communication between downhole sensors and the surface has long been desirable. This communication is, for example, an integral part of methods known as Measurement-While-Drilling (MWD) and Logging-While-Drilling (LWD). Various methods that have been tried for this communication include electromagnetic radiation through the ground formation, pressure pulse propagation through the drilling mud, acoustic wave propagation through the metal drill string, and electrical transmission through an insulated conductor or cable arrangement. Each of these methods has disadvantages associated with signal attenuation, ambient noise, high temperatures and compatibility with standard drilling procedures.

The most commercially successful of these methods has been the transmission of information by pressure pulse in the drilling mud. However, attenuation mechanisms in the mud limit the effective transmission rate to less than 10 bits per second, even though higher rates have been achieved in laboratory tests.

Of the various alternatives to telemetry based on mud pulses, telemetry based on electrical transmission through an insulated conductor or cable arrangement has the considerable advantage of greatly increased data transmission rates.

There are a number of known methods that concern high-data-rate telemetry systems for MWD/LWD measurements using cables inside and/or outside the drillstring, however most suffer from severe limitations. Some techniques require a large number of connectors and are thus prone to reliability problems. Others require significant changes to operational procedures. The following examples of known methods will be briefly discussed.

U.S. Pat. No. 4,001,774 discloses a method wherein the communication link between a subsurface location in a well and the surface location is established and maintained through electromagnetic coupling between two insulated electric conductors locate insider the drillstring. The disadvantages of this type of arrangement include, due to hydraulic effects, risk of the loose end of the cable getting tangled. The method also relies on induction coupling which can be unreliable. Finally, the method requires that the cable be fished through each new pipe stand during drilling.

U.S. Pat. No. 4,098,342 discloses a technique that uses an insulated electric conductor inside the drillstring in a convoluted configuration to provide an excess length of conductor. The disadvantages of this type of arrangement include the problems associated with fishing the cable through each pipe stand, as well as the pulleys, weights and couplers exposed to the mud environment.

U.S. Pat. No. 4,143,721 discloses a technique of enabling an instrument and a connected flexible cable contained in a drillstring to be left inside the drillstring while a pipe section is being added to or removed from the drillstring. The disadvantages of this type of arrangement include relative vulnerability of the cable to damage, complexity in pipe handling, and the limitation of rotatability of the drillstring.

U.S. Pat. No. 4,153,120 discloses an arrangement using a cable inside a drillstring wherein the cable connection is temporarily broken when adding or removing pipe sections. A portion of the cable may be wound about an element within the drillstring, to be unwound therefrom each time the drill string is lengthened. The disadvantages of this type of arrangement include taking out the coil, unwinding and threading the cable which can be time consuming and costly.

U.S. Pat. No. 4,181,184 discloses that uses an all-internal kink resistant cable with a hanger fixed to the tool joints. The disadvantages of this type of arrangement include the need to fish the cable through each new stand of pipe; risk of tangling; and the increased pressure drop of the drilling mud due the decreased cross section available to carry mud.

U.S. Pat. No. 5,096,001 discloses technique wherein a sensor close to the drillbit in a deep small diameter section of the borehole is connected by cable within the drillstring to a mudpulse generator operating in an upper section of the borehole. The mudpulse generator transmits the signal to a receiver at the surface. The disadvantages of this type of arrangement include the limitation on data transmission rate due to the reliance on mud pulse telemetry. The system is also only capable of one-way transmission.

U.S. Pat. No. 4,057,781 discloses a method that combines the use of an inner cable and a drill pipe used as a conductor. The disadvantages of this type of arrangement include those associated with the use of an insulation coating on the casing.

U.S. Pat. No. 4,416,494 discloses a method using an internal cable that is stored within the drillstring as a coil in a flexible storage means. The disadvantages of this type of arrangement include the need to fish the cable through each stand of pipe.

Thus in light of the known techniques for telemetry, there is a need to an improved system and method.

SUMMARY OF THE INVENTION

According to the invention a system is provided for communication while drilling a borehole with a rotatable drillstring extending from a drilling rig at a top end to a drill bit attached to a bottom end, the communication system comprising a cable positioned along the outside of the rotatable drillstring for a portion of the length of the drill string, the cable being used for communication between the drilling rig and an assembly located in the borehole.

Also provided according to the invention is a method of communication while drilling a borehole between a drilling rig and an assembly in the borehole comprising the steps of:

drilling a borehole using a rotating drillstring extending from a drilling rig at a top end to a drill bit attached to a bottom end; and positioning a cable along the outside of a portion of the rotating drillstring, the cable being used for communication between the drilling rig and the down-hole assembly.

DETAILED DESCRIPTION OF THE INVENTION

Figure 1:
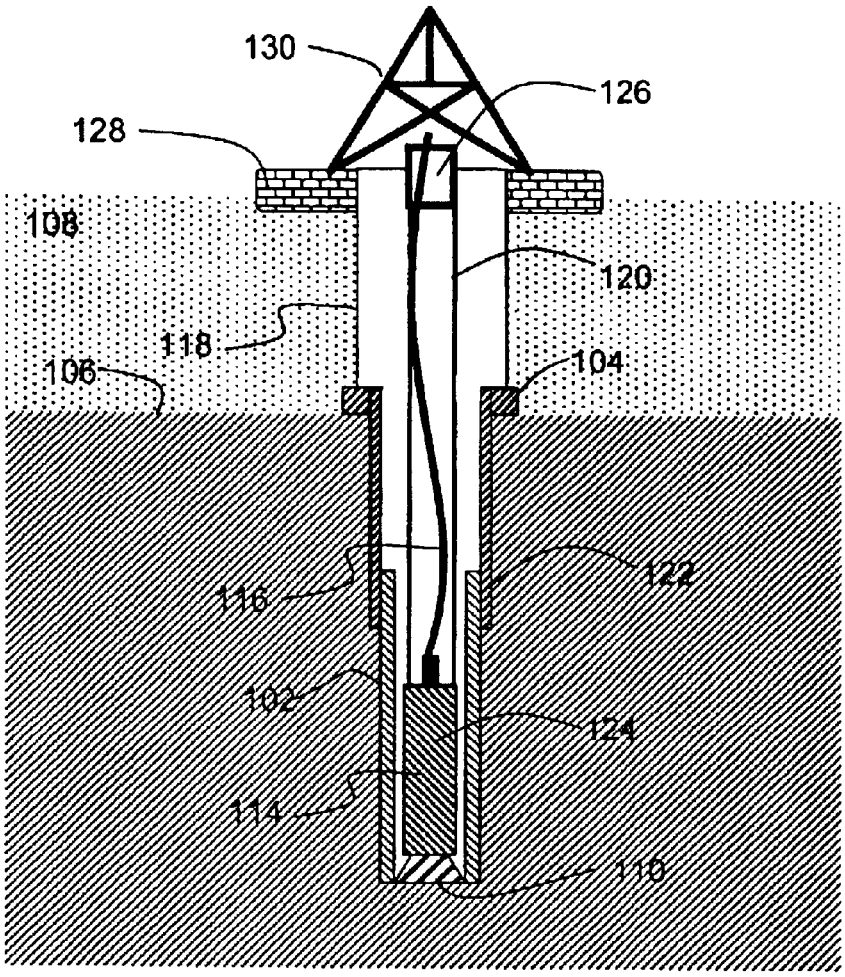
FIG. 1 shows a drilling system using a cable based telemetry system according to a preferred embodiment of the invention.

The following embodiments of the present invention will be described in the context of certain drilling arrangements, although those skilled in the art will recognize that the disclosed methods and structures are readily adaptable for broader application. Where the same reference numeral is repeated with respect to different figures, it refers to the corresponding structure in each such figure.

FIG. 1 shows a drilling system using a cable based telemetry system according to a preferred embodiment of the invention. Floating platform 128 is shown supporting drilling rig 130 in the sea 108. As will be described in further detail, the invention is preferably used in deep water drilling environments. However the invention can also be employed in shallower water, and is particularly useful where the anticipated bit runs are shorter than the depth of the water. In some cases, platform 128 could alternatively be a bottom-supported rig. Riser 118 is provided to serve as a conduit from the sea floor 106 to the platform 128. Riser 118 is connected to the blowout preventers (BOP) 104 located on the sea floor 106. Upper Casing 122 is shown beginning at the sea floor and extending into the earth. A second casing, or liner 102 extends from just above the end of casing 122, to which it is cemented, to near the bottom of the borehole. While only two casing diameters are shown in FIG. 1 for simplicity, in practice there will be a greater number of different diameter casings in the wellbore, with each successive deeper casing being of smaller diameter then that one above.

At the stage shown in FIG. 1, the liner 102 has just been installed, and the drill bit 110, bottom hole assembly 114, and drillpipe 120 has then been put in the wellbore in preparation for further drilling. Bottom hole assembly (BHA) 114 contains a number of devices. According to the invention, measurement-while-drilling (MWD) subassemblies are included in subassemblies 60. Examples of typical MWD measurements include direction, inclination, survey data, downhole pressure (inside and outside drill pipe), resistivity, density, and porosity. Additionally or alternatively, BHA 114 could contain LWD instruments. Cable 116 is provided inside drillpipe 120 and extends from a cross-over sub assembly 126 to a wet connect 124 on BHA 114. Since cable 116 will be exposed to the hydraulic stress of the pumped drilling fluid, it should be suitably constructed, such as a wireline-type cable. The crossover sub 126 allows electrical connection from the inside of the drillpipe to the outside of the drillpipe.

The drilling rig 130 includes a derrick, as well as a hoisting system, a rotating system and a mud circulation system, not shown. A top-drive rotating system is provided that imparts a rotational force on the drillpipe 120.

The mud circulation system pumps drilling fluid down the drillstring which comprises drillpipe 120 and BHA 114. The drilling fluid is often called mud, and it is typically a mixture of water or diesel fuel, special clays, and other chemicals.

The mud passes through the drillstring and through drill bit 110. As the teeth of the drill bit grind and gouges the earth formation into cuttings the mud is ejected out of openings or nozzles in the bit with great speed and pressure. These jets of mud lift the cuttings off the bottom of the hole and away from the bit, and up towards the surface in the annular space between the drillstring and the wall of borehole.

Figure 2:
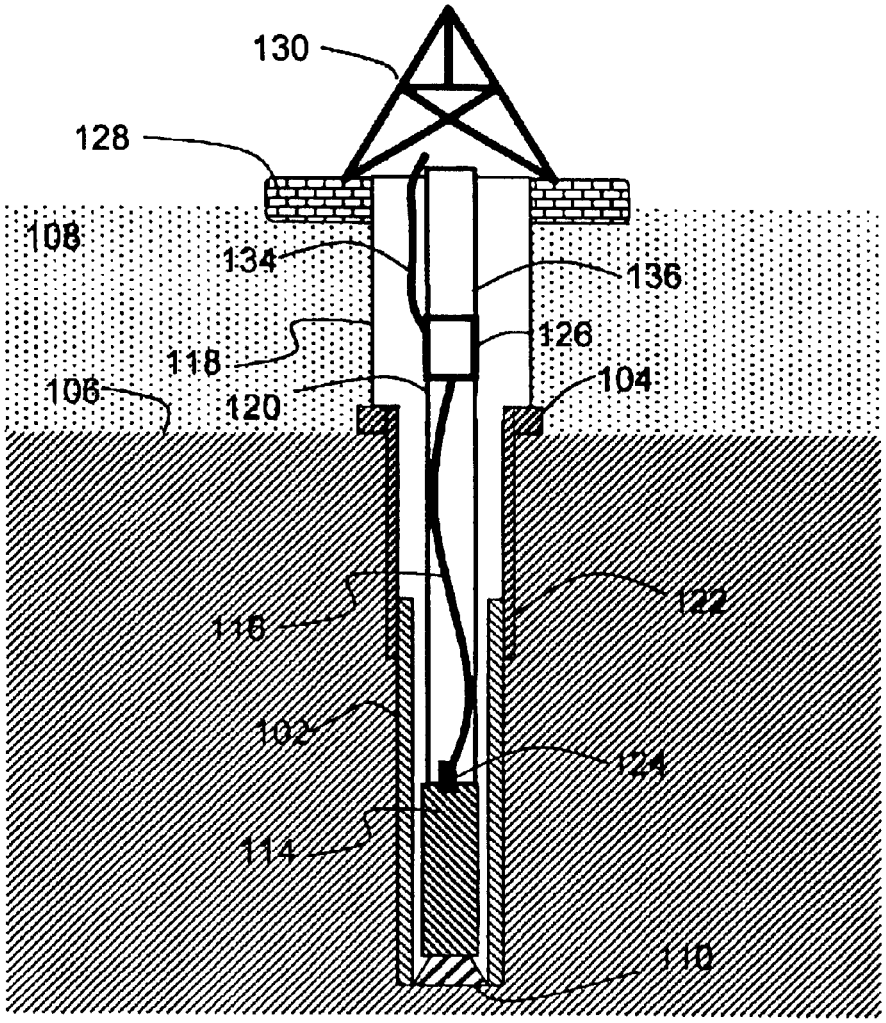
FIG. 2 shows a drilling system using a cable based telemetry system at a slightly later stage than shown in FIG. 1, according to a preferred embodiment of the invention.

FIG. 2 shows a drilling system using a cable based telemetry system at a slightly later stage than shown in FIG. 1, according to a preferred embodiment of the invention. As rotary drilling commences, new sections of drillpipe (shown as reference numeral 136) have been added above crossover sub 126. Cable 134 is connected to the crossover sub 126 and extends upward in the annular space between drill pipe 136 and riser 118 to the rig 130. In this way, a high data rate communication link is maintained between the BHA 114 and the rig 130. Communication though cables 134 and 116 can be two-way, and at very high data rates.

Figure 3:
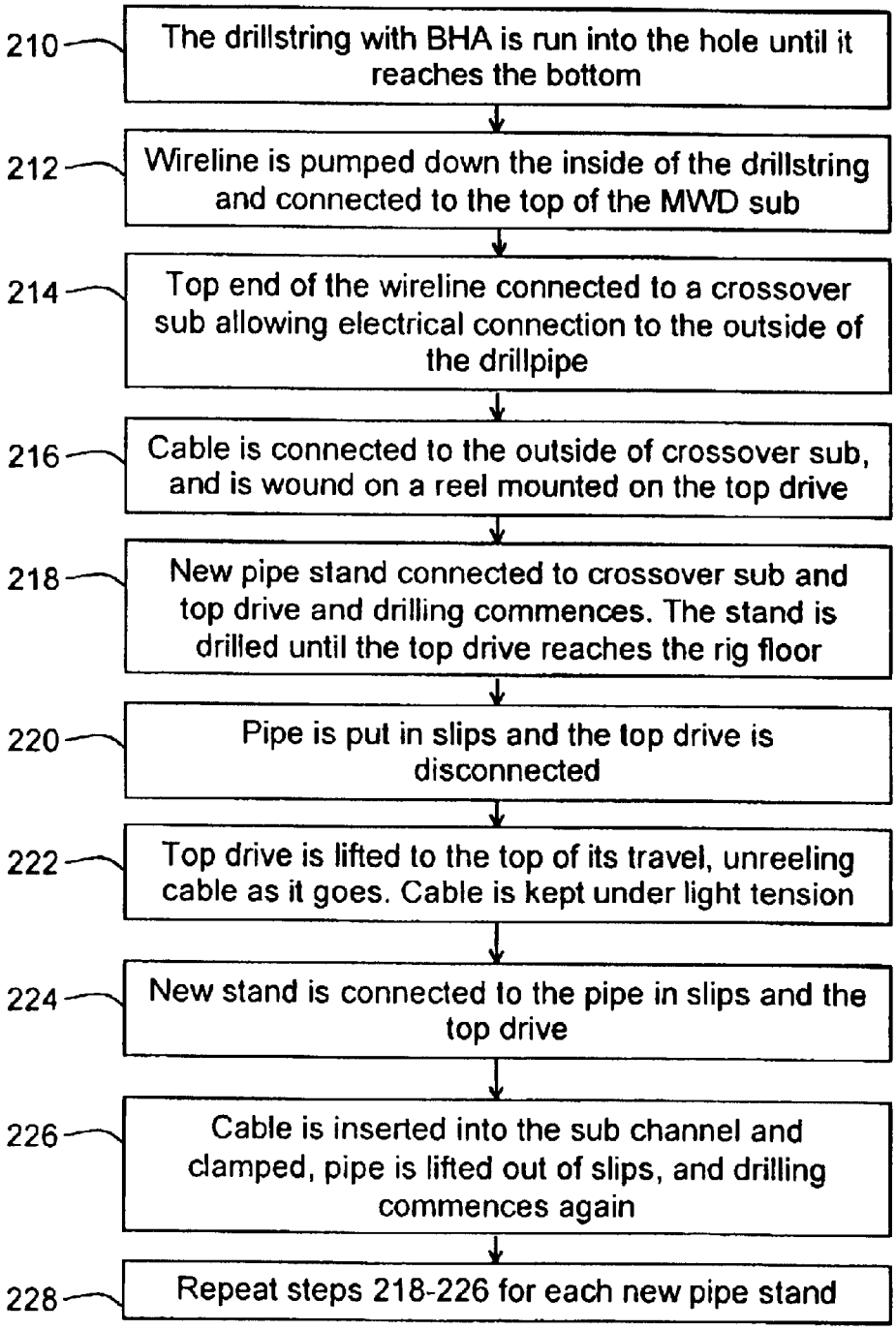
FIG. 3 is a flow chart showing the steps of drilling a wellbore using cable based telemetry, according to a preferred embodiment of the invention.

FIG. 3 is a flow chart showing the steps of drilling a wellbore using cable based telemetry, according to a preferred embodiment of the invention.

In step 210, the drillstring, with MWD tools in the bottom hole assembly (BHA), is run into the hole in the usual way until it reaches the bottom of the wellbore.

In step 212, a wireline is pumped down the inside of the drillstring. The lower end of the wireline is equipped with a wet connect system which latches on to the top of the MWD subassembly.

In step 214, the top end of the wireline is connected to a "crossover" subassembly which allows electrical connection to the outside of the drillpipe, as shown and described in FIG. 1 and associated text.

In step 216, a cable is connected to the outside of this crossover sub. This cable is wound on a reel which is mounted on the top drive unit. The reel can rotate with the top drive, or be driven independently.

In step 218, a new drillpipe stand is connected to the crossover sub and top drive in the usual way, and drilling commences. The cable reel is mounted in such a way that it rotates with the drillpipe. The stand is drilled until the top drive reaches the rig floor.

In step 220, the pipe is put in slips (provision is made such that the cable is not damaged by the slips) and the top drive is disconnected. During disconnection the cable reel does not turn with the top drive shaft. Provision is preferably made to ensure the cable is not damaged by the pipe handling equipment while connections are being made or broken.

In step 222, the top drive is lifted to the top of its travel, unreeling the cable as it goes. The cable is kept under a small amount of tension.

In step 224, a new stand is connected to the pipe in slips and the top drive. The cable reel does not spin while this is happening. Connected to the bottom of this stand is a small sub which has a larger outer diameter than the drillpipe tooljoints. The sub contains a channel for the cable, and a means of clamping the cable securely into this channel.

In step 226, the cable is inserted into the sub channel and clamped, the pipe is lifted out of slips, and drilling commences once again.

In step 228, steps 218 through 226 are repeated for each pipe stand drilled.

The above procedure leads to a system where, for most of its length, the cable is inside the drillstring. For the upper section the cable is on the outside of the drillstring. However it is not in the "hole", but in the riser. Since the riser is large in diameter (usually around 18 inches inner diameter (around 46 cm), it provides a relatively benign environment for the cable. Because the BOP's are on the seabed, that part of the pipe with the cable on the outside does not need to go through the BOP's.

The invention is also applicable where a bit run is longer than the riser. In this case the length of the cable inside the pipe is increased. To do this a short trip is used, as is known as "a wiper trip". The pipe is pulled until the crossover sub is at the rig floor. The cable is disconnected, and the pipe is then tripped back in using normal stands. When the bottom of the hole is reached, a new wireline is pumped down the hole until it connects with the top of the crossover sub, which has a wet connect facility. A new crossover sub is mounted at the top of the pipe and the cable is once more connected to the outside. Drilling now proceeds as previously described.

Referring again to FIG. 2, cable 134 on the outside of the pipe is preferably securely clamped every stand, which is typically about 96 feet long (about 29 meters). Cable 134 does not have to support any significant tension, and as such can be made a relatively small cross section. It must survive the handling and general environment, but need not be as strong as conventional wireline cable (such as what is preferably used for the lower cable 116). As such cable 134 can be of small diameter, keeping the size and weight of the cable reel assembly low. According to an alternative embodiment of the invention cable 134 is used to transmit power to the downhole tools. This is not ordinarily necessary since power can be provided by downhole turbines or batteries as is the case for existing MWD systems. If no power transmission is required, then cable 134 can comprise either an electrical conductor, or a fibre-optic cable could be used.

Figure 4:
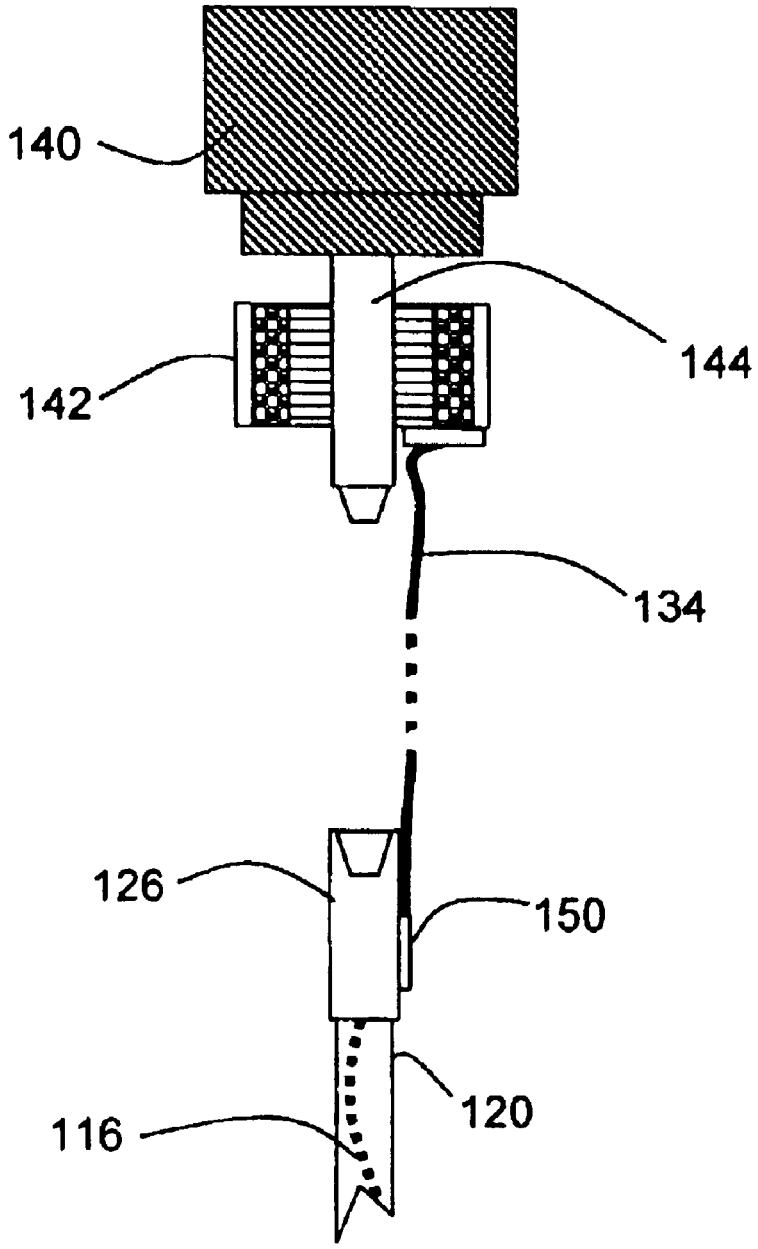
FIGS. 4–6 show in greater detail a system for drilling a wellbore using a cable based telemetry, according to a preferred embodiment of the invention.
Figure 5:
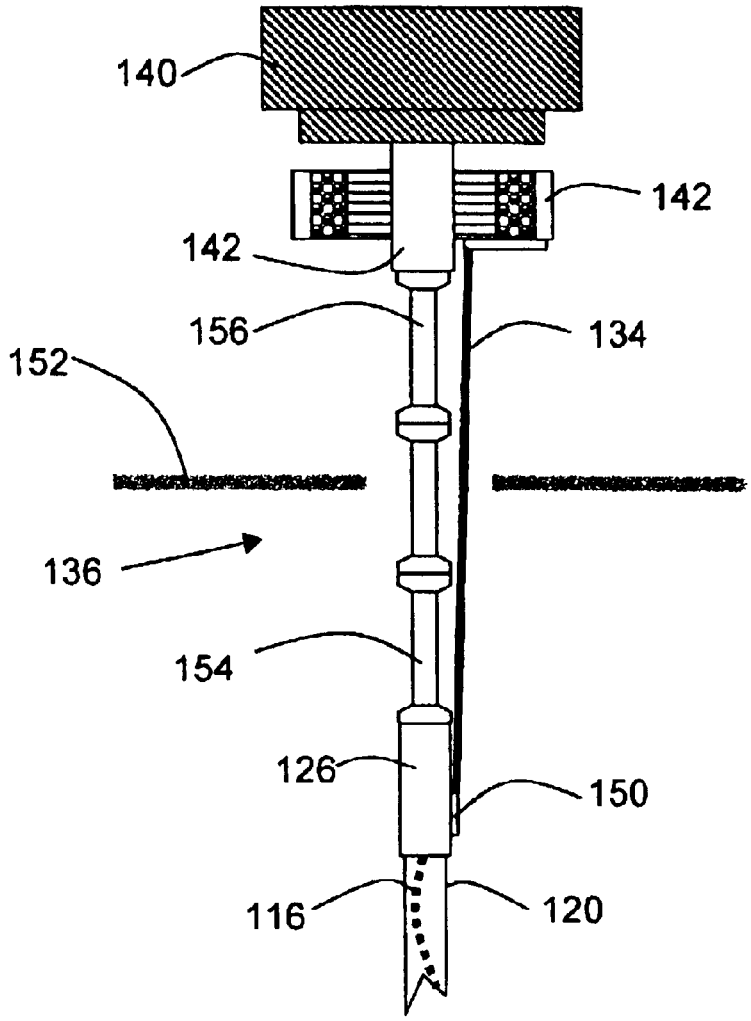
Figure 6:
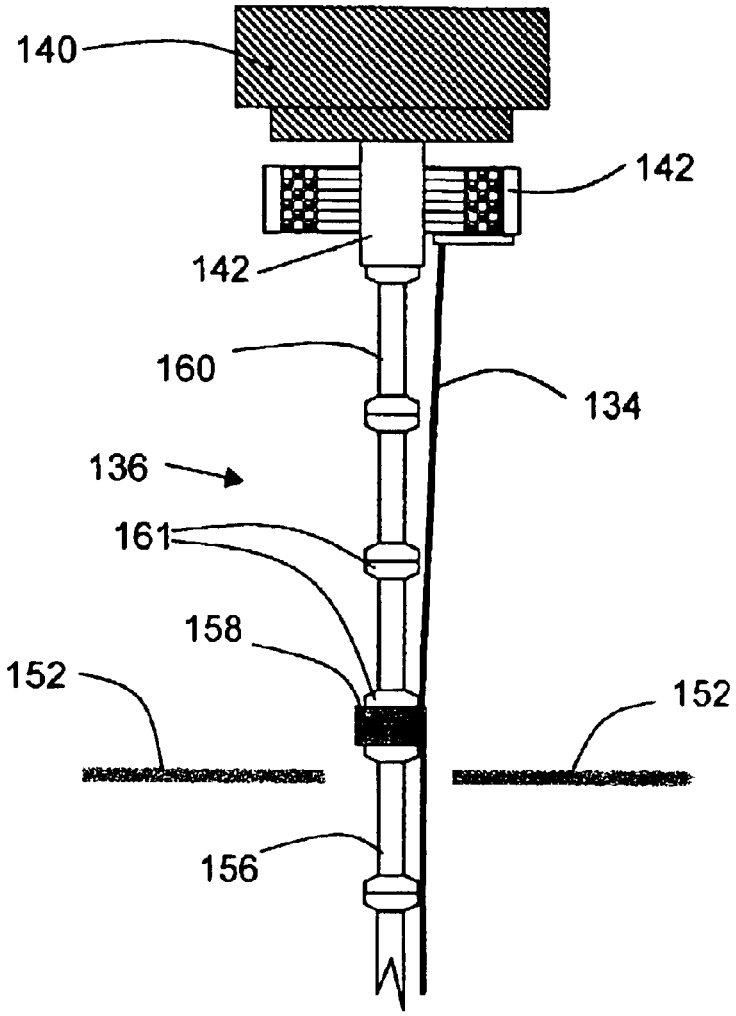

FIGS. 4–6 show in greater detail a system for drilling a wellbore using a cable based telemetry, according to a preferred embodiment of the invention. In FIG. 4, top drive unit 140 (also known as a power swivel) is provided to rotate the drill string and bit. The rig's travelling block (not shown) suspends the top drive unit 140. Top drive unit 140 includes one or more powerful electric or hydraulic motors that rotate the top drive shaft 144 under the control of the drilling operators. According to the invention, cable reel 142 is provided just below the top drive unit 140 and around the top drive shaft 144. Cable reel 142 houses cable 134 in a coiled fashion. Preferably, cable reel 142 is designed so as to store at least a length of cable 134 as long as the longest bit run. Cable reel 134 is mounted in such a way that it rotates with the drillpipe during drilling operations. However, when the top drive is disconnected from the drillpipe, the cable reel does not turn with the top drive shaft 144. The cable reel also should not rotate with the top drive when tool joints are torqued and untorqued. The system is also designed so as to allow the cable reel 142 to rotate while the top drive 140 is not rotating, to allow the cable 134 to be reeled in and out while tripping or when adding a new stand. Since the cable 134 preferably has a small diameter, and its length need be no more than the length of the riser, the reel unit 142 can be quite small. There is also a facility on the inside of the cable reel (for example a slip-ring assembly or radio transmission assembly) to allow the data to be transferred to the logging unit (not shown).

Crossover sub 126 includes a connector 150 for connection to cable 134. Crossover sub 126 is shown connected to drillpipe 120 inside which contains the cable 116. Using crossover sub 126, there is a direct communication link between cable 136, cable 120, and the LWD/MWD subassemblies in the bottom hole assembly. Note that the position shown in FIG. 4 on the drill rig 130 corresponds to the completion of step 216 in FIG. 3.

FIG. 5 shows the drill rig 130, including the drill floor 152 after three sections of drillpipe (often this is a single "stand" of drillpipe) have been installed. At this time, corresponding to step 218 in FIG. 3, top drive unit 140 is rotating the drillstring and drilling is progressing. Note that drillpipe 136 is presently comprised of sections of drillpipe such as 154 and 156. A slight tension is preferably maintained on cable 134 so as to avoid tangling and damage to the cable.

FIG. 6 shows the drilling process after a clamping sub 158 is installed which holds cable 134 securely to the drillpipe 136. A clamping sub 158 is preferably used on each stand of drill pipe (3 sections of drillpipe as shown in the example of FIG. 6). Clamping sub 158 prevents unwanted twisting or tangling of cable 134 with respect to drillpipe 136, and protects the cable from impact damage with the inner wall of riser 122.

In the event that the cable 136 snags on something it is important that it does not become tangled around the drillpipe and cause the pipe to either become stuck or affect the operation of the BOP's. Therefore, clamping force exerted by clamping sub 158 should be such that the cable 134 breaks before it is pulled out of the clamp. Clamping sub 158 also protects the cable 134 from damage as the drillpipe interacts with the riser wall. The outer diameter of the clamping sub should be larger than the normal drillpipe tooljoint 161, as is shown in FIG. 6. In this way the cable 134 cannot be pinched between a tooljoint and the riser. In cases where a bending of the riser is substantial, the clamping sub 158 should be made even larger so as to prevent pinching from the tooljoints 161.

Clamping subs should be simple and easy to operate. They should have very few or no moving parts. It may be that the clamping unit does not have to be a separate sub, but could be a clamp-on unit which fits over the drillpipe, such as is known with the use of clamp-on stabilisers.

Figure 7:
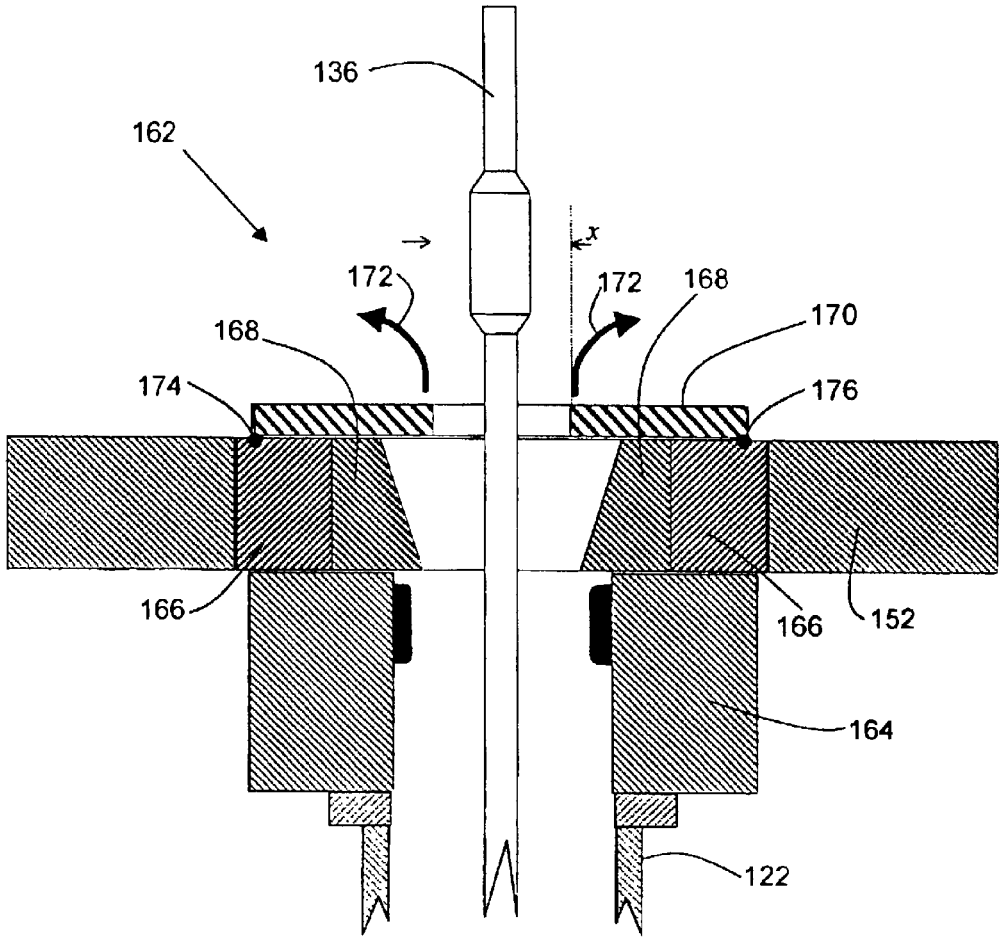
FIG. 7 shows an arrangement for a rotary table, according to a preferred embodiment of the invention.

FIG. 7 shows an arrangement for a rotary table, according to a preferred embodiment of the invention. Slips bowl 168 is provided so that the slips may be inserted to hold the drillpipe when disconnected from the top drive. Slips bowl 168 is mounted on the drill floor 152 with bushing 166. Below the drill floor 152 is a flow diverter 164, which diverts the flow of drilling mud away from the opening at the top of the drill floor. The top of riser 122 is shown immediately below the flow diverter. The diameter of the hole in plate 170 (denoted by the distance x) is preferably less than the diameter of the base of the slips bowl.

During ideal drilling conditions the drillpipe 136 passes through the centre of the hole in the rotary table 162 without touching the sides. However, sometimes conditions arise when the drillpipe will move from side to side, impacting the protective plate 170. This can happen because of whirl of the drillstring or because the rig tilts due to wave motion, etc. Occasionally the amount of tilt will be so great that the drillpipe is in continuous contact with the protective plate 170, while rotating. The plate 170 is usually made from a soft material, such as aluminium. The main purpose of plate 170 is to prevent damage to the drillpipe and to the slips bowl 168 (or the slips themselves if automatic slips are fitted). When the protective plate 170 is damaged it can be easily replaced. The plate also has to be easily removable, to allow access to the slips. This is usually achieved by making plate 170 in two parts, which are attached to the drill floor using hinges 174 and 176, allowing it to be opened, as shown by arrows 172.

If the cable is caught between the drillpipe and the plate 170 it can be severely damaged. To prevent this happening, the protective plate is preferably modified according to the invention. The modifications allow the cable to survive when the drillpipe impacts the protective plate. The cable will also be protected when the drillpipe is in continuous contact with the plate while rotating.

Figure 8:
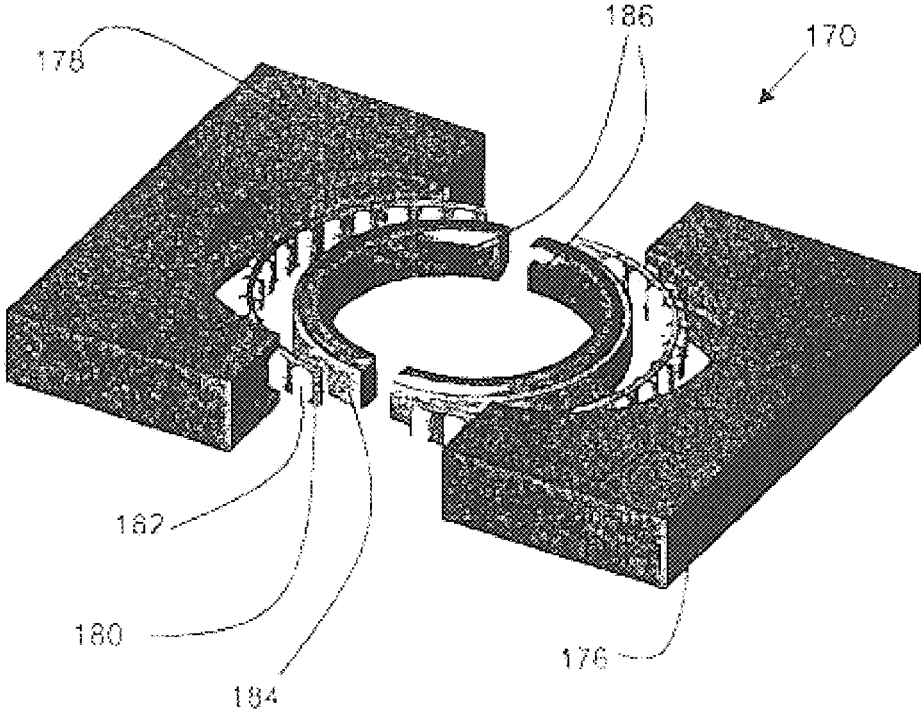
FIG. 8 shows further detail of a protective plate 170, according to a preferred embodiment of the invention.

FIG. 8 shows further detail of a protective plate 170, according to a preferred embodiment of the invention. The right and left halves of the plate are shown 176 and 178. The hole in the centre of the protective plate is fitted with an element 184 that is mounted on bearings 182. The bearings 182 are held in position with bearing race 180. Element 184 is coated with a compliant material 186, such as rubber or the like. The coating 186 is of appropriate thickness and stiffness, so that when the drillpipe impacts the side of the hole, the cable is pressed into the material.

The element 184 and bearing race 180 are preferably in at least two parts to enable the protective plate 170 to be opened, allowing access to the slips bowl. Before opening, the element can be rotated to ensure the joints in element 184 and race 180 line up with the joint between the right and left halves 176 and 178.

Figure 9:
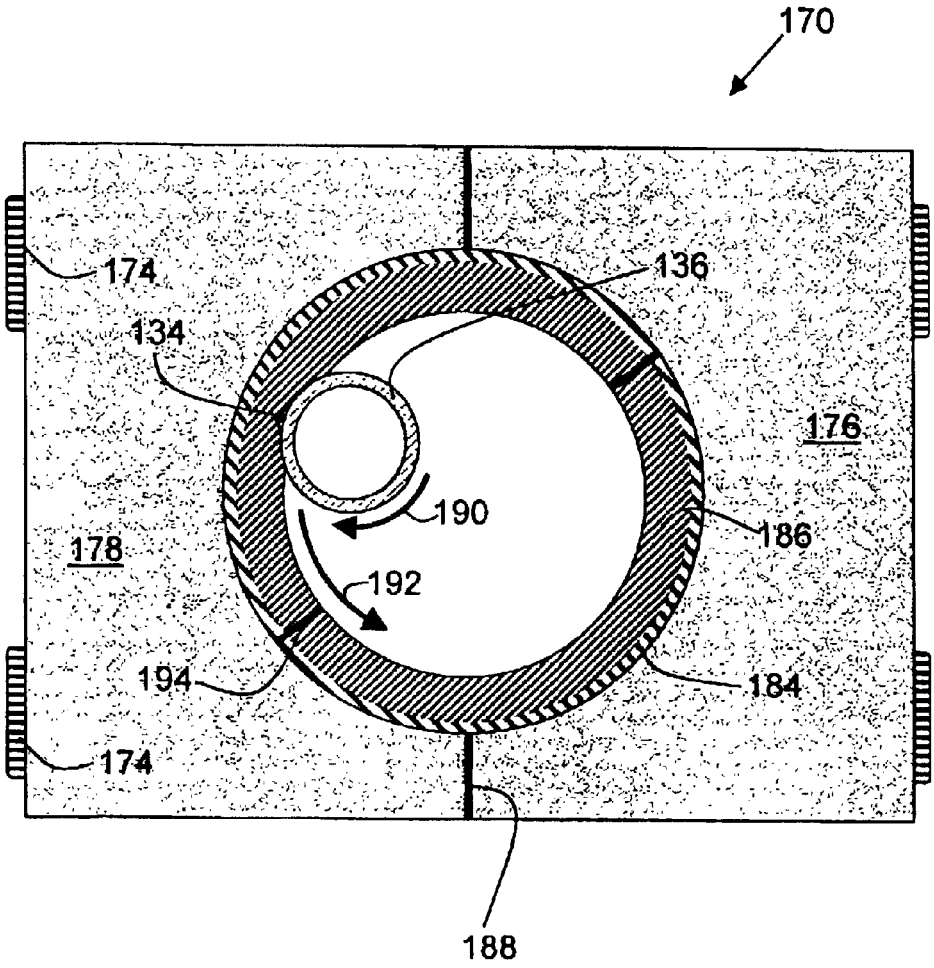
FIG. 9 is a plan view showing further detail of the embodiment of the protective plate 170 shown in FIG. 8.

FIG. 9 is a plan view showing further detail of the embodiment of the protective plate 170 shown in FIG. 8. The joint between the right and left halves 176 and 178 is shown with reference number 188. The joints in element 184 and race 180 are shown with reference number 194. Drillpipe 136 is shown impacting the protective plate 170. The force of the impact is distributed over a large area, reducing the compressive load on the cable 134. In the case where the drillpipe is in continuous rotating contact with the element, then because the element is mounted on bearings, it will rotate with the pipe. The direction of rotation of the drillpipe 136 is shown with arrow 190, and the direction of rotation of element 184 and compliant material 186 is shown with arrow 192. As can be seen, the cable 134 is pulled through the contact area between the pipe 136 and the element 184 and will not be damaged.

Figure 10:
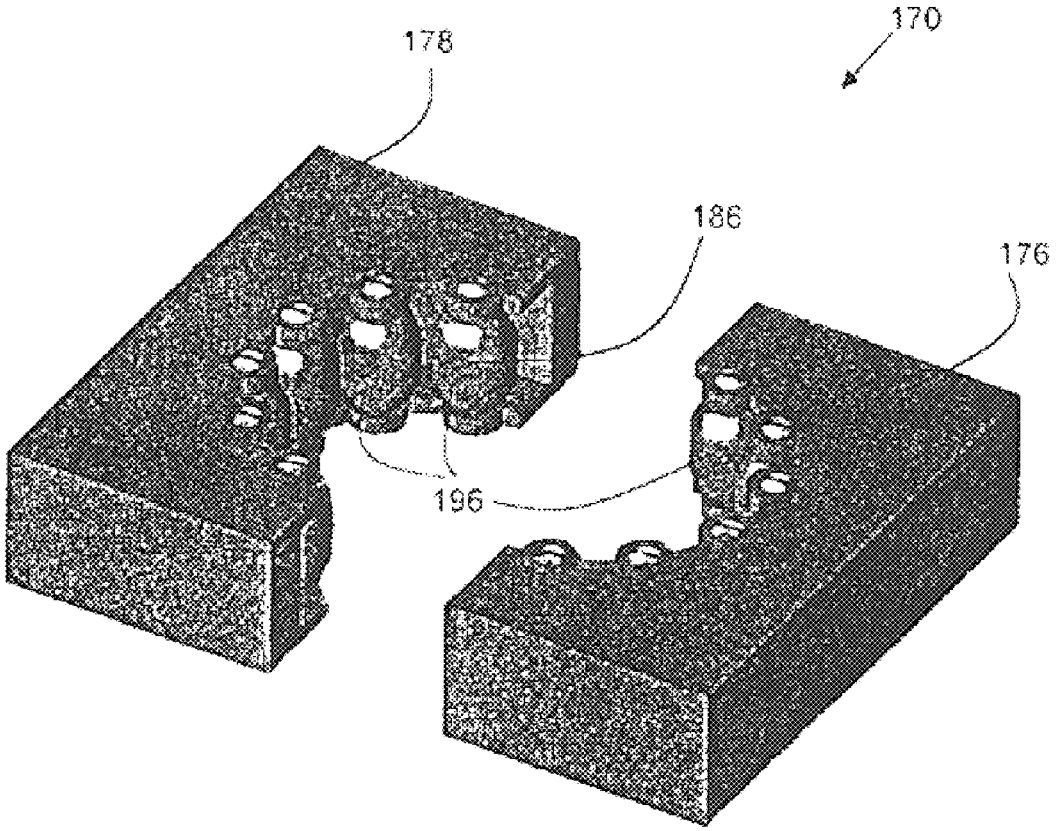
FIG. 10 shows an alternative version of protective plate 170, according to another embodiment of the invention.

FIG. 10 shows an alternative version of protective plate 170, according to another embodiment of the invention. According to this embodiment, the compliant coating 186 is applied to a series of rollers 196 arranged symmetrically around the hole in plate 170. Once again the thickness and stiffness of the coating 186 is selected to be appropriate in reducing the loading on the cable in the event of an impact. As in the embodiment shown in FIGS. 8 and 9, when the drillpipe is in continuous rotating contact with two of the rollers, the cable will be pulled through without damage.

While preferred embodiments of the invention have been described, the descriptions are merely illustrative and are not intended to limit the present invention. For example whole the preferred embodiments have been described in the context of deep water drilling the invention is also applicable to shallower water and land wells.

What is claimed is:

1. A system for communication while drilling a borehole with a rotatable drillstring extending from a drilling rig at a top end to a drill bit attached to a bottom end, the communication system comprising:

a cable positioned along the outside of the rotatable drillstring for a portion of the length of the drill string, the cable being used for communication between the drilling rig and an assembly located in the borehole, and a cross-over sub assembly adapted to be assembled into the drillstring between two sections of drill pipe, wherein the cable at its bottom end is electrically connected via the cross-over sub assembly to a second cable that runs inside the drillstring.

2. The system of claim 1 wherein the borehole is being drilled to facilitate hydrocarbon production.

3. The system of claim 2 wherein the borehole is being drilled on the seafloor and the drilling rig is on the sea surface.

4. The system of claim 3 wherein a riser is provided outside the drillstring between the seafloor and the drilling rig.

5. The system of claim 4 wherein length of the riser is longer than one or more bit runs planned for drilling the borehole.

6. The system of claim 3 wherein the portion of the length of the drillstring where the cable is positioned outside the drillstring is within a substantial portion of the length of the riser.

7. The system of claim 1 wherein the assembly is located in a bottom hole assembly that forms part of the drillstring and is located near the drill bit.

8. The system of claim 1 wherein the cable is located inside the drillstring at locations below said portion of the length of the drillstring where the cable is positioned outside the drillstring.

9. The system of claim 1 wherein the cross-over sub assembly supports the weight of the second cable.

10. The system of claim 9 wherein the cross-over sub assembly comprises a wet connect type connection on an upper end of the sub assembly for connection to a third cable.

11. The system of claim 1 wherein in the drilling rig portions of the cable a rotating reel mounted above the drillstring.

12. The system of claim 11 wherein the reel is mounted on a top drive assembly used to rotate the drillstring.

13. The system of claim 12 wherein the reel is mounted such that it can be selectively rotated either with the drillstring or independently from the drillstring.

14. The system of claim 1 wherein the drilling rig includes a rotary table which comprises a system for protecting the cable from impact between a portion of the rotary table and the outer surface of the drillstring.

15. The system of claim 14 wherein the system for protecting the cable comprises an element on the rotary table containing a compliant material, the element being able to rotate when in contact with the drillstring.

16. The system of claim 15 wherein the element is part of a ring shaped bushing that surrounds the drillstring and rotates with the drillstring when in contact with the drillstring.

17. The system of claim 14 wherein the system for protecting the cable comprises a plurality of rollers that can rotate with the drillstring when in contact with the drillstring.

18. The system of claim 1 further comprising a clamp assembly that holds the cable securely on the outside of the drillstring.

19. The system of claim 18 wherein the clamp assembly is dimensioned so as to protect the cable from impact with the inner surface of a conduit through which the drillstring is passed.

20. The system of claim 1 wherein the assembly located in the borehole comprises a wet connect type connection adapted to connect to the lower end of the second cable.

21. A method of communication while drilling a borehole between a drilling rig and an assembly in the borehole comprising the steps of:

drilling a borehole using a rotating drillstring extending from a drilling rig at a top end to a drill bit attached to a bottom end;

assembling a cross-over sub assembly into the drillstring between two sections of drill pipe;

positioning a cable along the outside of a portion of the rotating drillstring, the cable being used for communication between the drilling rig and the down-hole assembly; and connecting the cable at its bottom end electrically via the cross-over sub assembly to a second cable that runs inside the drillstring.

22. The method of claim 21 wherein the borehole is being drilled in the seafloor and the drilling rig is on the sea surface, a riser is provided outside the drillstring between the seafloor and the drilling rig, and the length of the riser is longer than one or more bit runs planned for the drilling of the borehole.

23. The method of claim 22 wherein the portion of the drillstring where the cable is positioned is inside part of the riser.

24. The method of claim 21 wherein the cable at its bottom end is electrically connected via a cross-over sub assembly to a second cable that runs inside the drillstring from the cross-over sub assembly towards the drill bit.

25. The method of claim 21 wherein in the drilling rig portions of the cable are wound on a rotating reel mounted above the drillstring, the reel being mounted on a top drive assembly used to rotate the drillstring, and wherein the reel is selectively rotated with the drillstring or independently from the drillstring.

26. The method of claim 21 wherein the drilling rig comprises a rotary table that includes an element containing a compliant material, the element being able to rotate when in contact with the drillstring, thereby protecting the cable from impact between a portion of the rotary table and the outer surface of the drillstring.

27. The method of claim 21 wherein the step of positioning comprising the step of clamping the cable securely to the outside of the drillstring using a clamp assembly that is dimensioned so as to protect the cable from impact with the inner surface of a conduit through which the drillstring is passed.

* * * * *